United States Patent [19]

Olson

[11] Patent Number: 4,861,951

[45] Date of Patent: Aug. 29, 1989

[54] ROTARY SWITCH WITH INDEXING STRUCTURE MOUNTED TO A PRINTED CIRCUIT BOARD

[75] Inventor: Elwyn H. Olson, St. Paul, Minn.

[73] Assignee: Honeywell Inc., Minneapolis, Minn.

[21] Appl. No.: 218,182

[22] Filed: Jul. 13, 1988

[51] Int. Cl.[4] ..... H01H 19/58

[52] U.S. Cl. ..... 200/11 DA; 200/565; 200/292

[58] Field of Search ..... 200/11 R, 11 A, 11 D, 200/11 DA, 11 G, 11 J, 11 K, 11 TW, 155 R, 292, 303, 564–572

[56] References Cited

U.S. PATENT DOCUMENTS

| | | | |
|---|---|---|---|
| 3,300,594 | 1/1967 | Paine et al. | 200/11 G |
| 3,437,766 | 4/1969 | Ahrens | 200/11 J X |
| 3,699,279 | 10/1972 | Lockard et al. | 200/11 DA X |
| 3,903,383 | 9/1975 | Marker | 200/11 TW |
| 4,490,588 | 12/1984 | Guenther et al. | 200/11 DA X |
| 4,551,587 | 11/1985 | Rose | 200/292 X |
| 4,625,084 | 11/1986 | Fowler et al. | 200/11 DA |

*Primary Examiner*—J. R. Scott

*Attorney, Agent, or Firm*—Mitchell J. Halista; Clyde C. Blinn; Albin Medved

[57] ABSTRACT

A printed circuit board mounted rotary electrical switch has a rotatable electrical contact carrier mounted for rotation within a cup-shaped housing and carrying indexing and rotation limiting devices cooperating with the housing. An electrical contact strip is carried by the rotatable carrier for selectively providing a direct electrically conductive bridge between pairs of a plurality of projecting electrical contacts attached to the circuit board and to corresponding printed wiring on the circuit board. The housing is attached to the circuit board by screws threaded into the circuit board through perforated ears projecting from respective sides of the housing. The carrier and the housing are made of an electrically non-conductive material to protect the strip and the contacts from extraneous electrical paths.

5 Claims, 3 Drawing Sheets

ROTARY SWITCH WITH INDEXING STRUCTURE MOUNTED TO A PRINTED CIRCUIT BOARD

BACKGROUND OF THE INVENTION

1. Field of the Invention

The present invention is directed to electrical switches. More specifically, the present invention is directed to electrical rotary switches.

SUMMARY OF THE INVENTION

An object of the present invention is to provide an improved rotary electrical switch for mounting on a printed circuit board.

In accomplishing this and other objects, there has been provided, in accordance with the present invention, a rotary electrical switch for mounting on a printed circuit board and providing selective direct electrical interconnections among printed wiring electrical contacts carried by the printed circuit board and having an electrical contact strip, a rotatable indexing means for supporting the contact strip, a shaft for rotating the indexing means and a housing having indentations cooperating with the indexing means and outwardly protecting ears attached to the housing for mounting the switch on a printed circuit board to allow the contact strip to direclty cooperate with the printed wiring electrical contacts carried by and projecting from the printed circuit board to provide selective electrical connections therebetween.

BRIEF DESCRIPTION OF THE DRAWINGS

An better understanding of the present invention may be had when the following detailed description is read in connection with the accompanying drawings, in which.

DESCRIPTION OF THE PREFERRED EMBODIMENT

Figure 1:
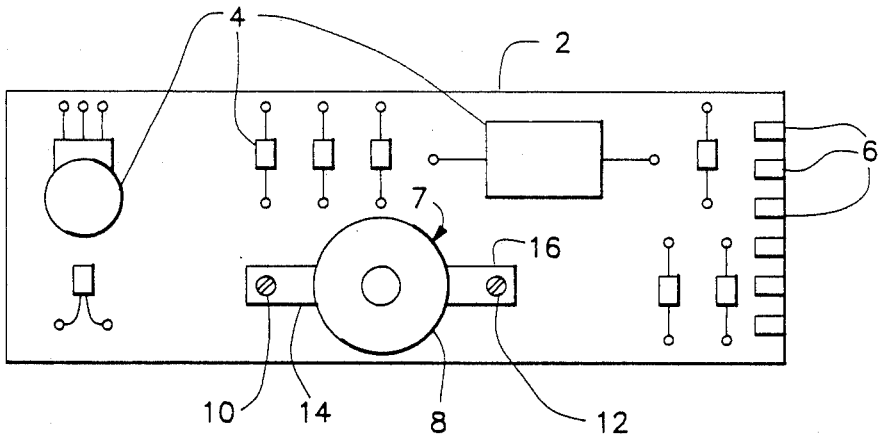
FIG. 1 is a top view of a printed circuit board with a rotary electrical switch incorporating an embodiment of the present invention mounted thereon.

Referring to FIG. 1 in more detail, there is shown a printed circuit board 2 having a plurality of electrical components 4 mounted thereon in contact with printed wiring (not shown) on the board 2, and a plurality of contact strips 6 located at one end of the circuit board 2 for connecting the printed circuit wiring to associated equipment (not shown). A rotary switch 7 having a housing 8 and embodying an example of the present invention is mounted on the printed circuit board 2 by screws 10,12 projecting through ears 14,16 extending outwardly from respective sides of the switch housing 8. The screws 10,12 are threaded into corresponding threaded holes within the printed circuit board 2.

Figure 2:
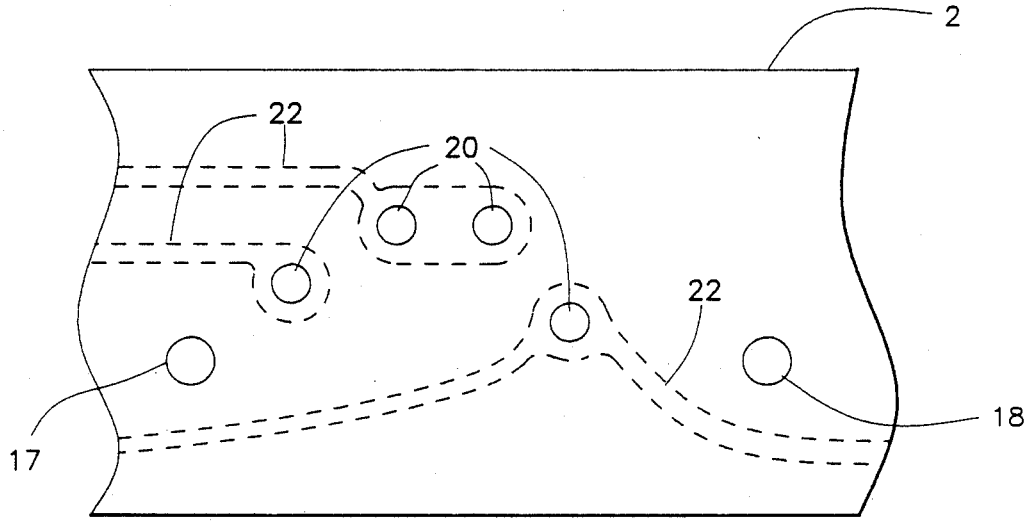
FIG. 2 is a top view of the portion of the circuit board shown in FIG. 1 under the rotary switch.

Referring to FIG. 2, there is shown a partial illustration of the printed circuit board 2 shown in FIG. 1 underneath the switch 8. A pair of threaded holes 17,18 are located in the printed circuit board 2 for accepting the mounting screws 10,12. A plurality of projecting electrical contacts 20 having hemispherical contact surfaces are provided in the circuit board 2 and attached thereto by any suitable conventional technique. The contacts 20 are connected to respective printed circuit board conductive lines 22 which provide electrical connections to the components 4 on the printed circuit board 2. The electrical contacts 20 are spaced apart along a semicircle and cooperate with an electrically conductive strip, as described hereinafter, carried within the housing 8 to provide selective electrical connections by a rotary motion of the switch 7 between the contacts 20 and the printed circuit lines 22.

Figure 3:
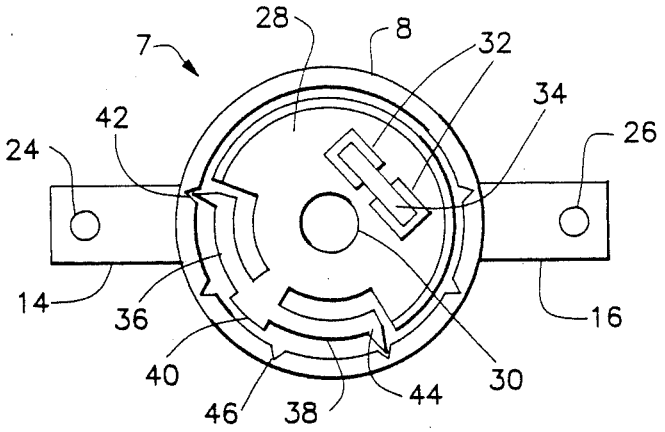
FIG. 3 is a bottom view of the rotary switch shown in FIG. 1.
Figure 8:
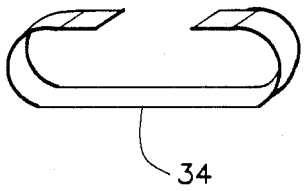

In FIG. 3, there is shown a bottom view of the switch 7, i.e., the side of the switch 7 facing the circuit board 2. The switch 7 includes an outer housing 8 having outwardly projecting ears 14,16 for fastening the switch 7 to the printed circuit board. The ears 14,16 are provided with through holes 24,26, respectively, for accepting corresponding ones of the mounting screws 10,12. A rotatable circular plate 28 is coaxially mounted within the housing 8 and is selectively rotatable within the housing 8 by a central shaft 30 extending out of the housing 8. The plate 28 has a pair of recesses 32 located on one side of the center shaft 30 for loosely capturing respective ends of an electrically conductive contact strip 34. An isometric illustration of the contact strip 34 is shown in FIG. 8.

On the other side of the center shaft 30, the plate 28 is arranged to carry a pair of semicircular flexible arms 36,36 extending in opposite directions from a center support 40 located on a periphery of the plate 28. The arms 36,38 each terminate in a projecting point, e.g., arm 36 terminates in projecting point 42, and arm 38 terminates in projecting point 44. The projecting points 42,44 are arranged to cooperate with transverse grooves, e.g., grooves 46, located on an inner surface of the housing 8. The grooves 46 are equally spaced on the inner wall of the housing 8 to provide a means for indexing the plate 28 over the extent of the rotary motion of the plate 28. In the illustrated embodiment, six indexing grooves 46 are located on the wall of the housing 8 to provide three indexing positions of the rotary plate 28.

Figure 4:
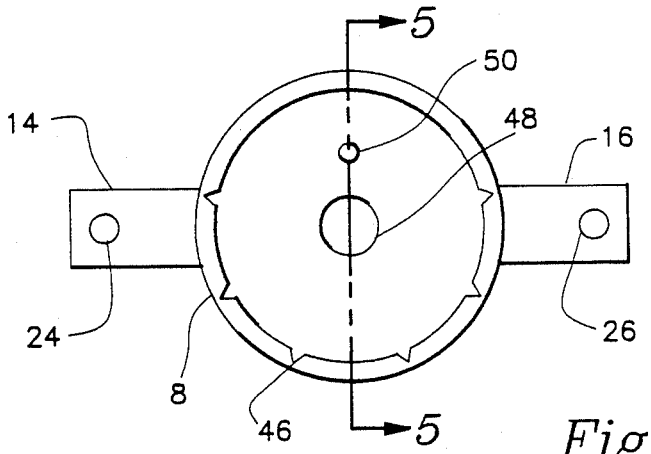
FIG. 4 is a bottom view of the switch housing shown in FIG. 3.

In FIG. 4, there is shown a view of the housing 8 without the rotary plate 28. A center hole 48 in the housing 8 may be seen from this illustration for allowing the center shaft 30 of the plate 28 to project therethrough. Additionally, an inwardly projecting post 50 is located on the inner surface of the housing 8 to limit rotary motion of the plate 28.

Figure 5:
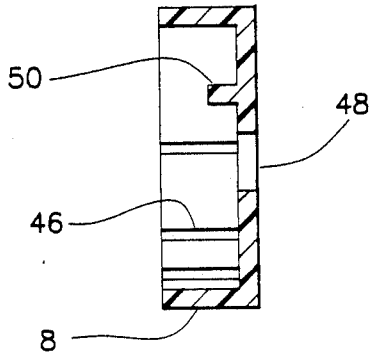
FIG. 5 is a cross-sectional illustration of the housing shown in FIG. 4 taken along line 5—5.
Figure 6:
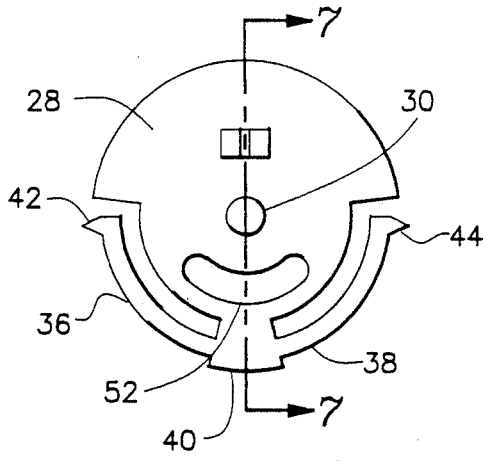
FIG. 6 is a top view of the rotatable contact carrying plate shown in the switch of FIG. 3.
Figure 7:
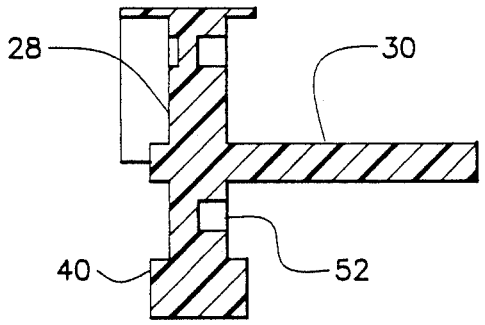
FIG. 7 is a cross-sectional illustration of the plate shown in FIG. 6 taken along line 7—7 and FIG. 8 is an isometric illustration of the contact strip used in the switch shown in FIG. 3.

In FIG. 5, there is shown a cross-sectional illustration of the housing 8 shown in FIG. 4 taken along line 5—5. The projecting limit post 50, the grooves 46 and the center hole 48 may be clearly seen from this cross-sectional illustration. The inner surface of the housing 8 is arranged to cooperate with the periphery of the rotary plate 28 to urge the contact strip 34 to bear against the contacts 20 on the printed circuit board 2. In FIG. 6, there is shown a top view of the rotary plate 28 to illustrate the semicircular groove 52 in the plate 28 which cooperates with the post 50 to limit the rotary motion of the plate 28. In FIG. 7, there is shown a cross-sectional illustration of the plate 28 of FIG. 6 taken along line 7—7.

The rotary electrical switch of the present invention is effective to provide a rotary switch for direct mounting on a printed circuit board 2 and providing an electrical switching action with respect to electrical contacts 20 mounted on the printed circuit board by a selective contact bridging operation through the contact strip 34 carried within the switch 7. The components of the switch 7 other than the electrical contact strip 34 are preferably made of an electrically insulating and self-lubricating material, e.g., plastic acetal, to protect the electrical strip 34, whereby electrical connections between the contact strip 34 are limited to the projecting contact elements 20 and to provide a slippery surface for the movement of the projecting points 42,44 thereacross during a rotation of the rotary plate 28.

Accordingly, it may be seen that there has been provided, in accordance with the present invention, an improved rotary electrical switch for direct mounting on a printed circuit board to provide selective electrical connections between the printed wiring on the printed circuit board.

The embodiments of the present invention in which an exclusive property or privilege is claimed are defined as follows:

1. A rotary electrical switch for mounting on a printed circuit board and providing selective direct electrical interconnections among printed wiring electrical contacts carried by the printed circuit board comprising an electrical contact strip, a rotatable indexing means for supporting the contact strip, a shaft for rotating the indexing means, a housing having location defining means cooperating with the indexing means for establishing a plurality of predetermined rotational indexed positions of said indexing means, said housing means including a first limit means defining a first and a second rotational limit position and said indexing means including a second limit means cooperating with said first limit means to limit a rotation of said indexing means between the first and second rotational limit positions, and outwardly projecting ears attached to said housing for mounting the switch on a printed circuit board to allow the contact strip to directing cooperate with the printed wiring electrical contacts carried by and projecting from the printed circuit board to provide selective electrical connections therebetween.

2. A rotary switch as set forth in claim 1 wherein said first limit means is a post and said second limit means is a semicircular groove accommodating a longitudinal portion of said post.

3. A rotary switch as set forth in claim 1 wherein said location defining means includes six indentations and said indexing means includes a pair of flexible arms each having a characterized end cooperating with a respective one of said indentations to provide three indexed positions of said indexing means.

4. A rotary switch as set forth in claim 1 wherein said indexing means and said housing are made of plastic acetal.

5. A rotary switch as set forth in claim 1 wherein said indexing means and said housing are made of an electrically insulating and self-lubricating material.

* * * * *